US006255630B1

(12) United States Patent
Barnes et al.

(10) Patent No.: US 6,255,630 B1
(45) Date of Patent: Jul. 3, 2001

(54) PROGRAM CONTROL AND DISPLAY SYSTEM FOR A COOKING APPLIANCE

(75) Inventors: Shelton T. Barnes, Chattanooga; Perry A. Bennett, Cleveland; Kenneth E. Sauter, Ooltewah, all of TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/387,736

(22) Filed: Sep. 1, 1999

(51) Int. Cl.[7] ..... H05B 1/02

(52) U.S. Cl. ..... 219/486; 219/483; 219/506; 219/414; 219/395; 99/328

(58) Field of Search ..... 219/506, 720, 219/411–415, 494, 501, 505, 497, 492, 395; 99/325–331

(56) References Cited

U.S. PATENT DOCUMENTS 4,328,408 * 5/1982 Lawson ..... 219/506
4,390,766 6/1983 Horinouchi .
4,636,621 1/1987 McGeorge .
4,687,910 * 8/1987 Aoshima et al. ..... 219/506
4,761,540 8/1988 McGeorge .
5,272,300 * 12/1993 Edamura et al. ..... 99/325
5,398,597 3/1995 Jones et al. .

* cited by examiner

*Primary Examiner*—Mark Paschall
(74) *Attorney, Agent, or Firm*—Everett G. Diederiks, Jr.

(57) ABSTRACT

A cooking appliance includes a control system which is programmable to enable multiple, successive cooking operations to be performed in sequence, with an alphanumeric display being provided to convey information concerning the successive cooking operations, such as the amount of time until the start of a subsequent cooking operation while an initial cooking operation is proceeding. Furthermore, the control system can be used to alter factory established set-up parameters such that the appliance can be conveniently customized by the consumer.

26 Claims, 2 Drawing Sheets

PROGRAM CONTROL AND DISPLAY SYSTEM FOR A COOKING APPLIANCE

BACKGROUND OF THE INVENTION

1. Field of the Invention

The present invention pertains to the art of appliances and, more particularly, to a system used to control the programming and display for a cooking appliance.

2. Discussion of the Prior Art

Many cooking appliances available in the marketplace today incorporate electronic controls. A typical electronically controlled cooking appliance will be provided with a control system used for selecting an operating mode and time. It is also known to incorporate a visual display as part of the appliance, with the control system determining the information presented in the display. More modern systems generally utilize alpha-numeric displays to convey to the user both a mode and time for a desired cooking operation.

However, prior systems do not enable the programming or information displaying of successive cooking operations. That is, it would be convenient to be able to program a cooking appliance to perform multiple cooking operations and to be able to display information concerning each of the cooking operations. For instance, during a first cooking operation within a cooking cavity, it would be convenient to be able to program a second cooking operation to follow the first cooking operation in the same cooking cavity. In addition, it would be beneficial to be able to display information to the user concerning the second cooking operation, such as the time until the start of the second cooking operation, while the first cooking operation is in progress.

Known cooking appliances including programming and displaying features are generally pre-programmed with fixed set-up parameters, such as the type of clock display, temperature scale, display illumination level and duration of an end of cooking operation signal. To be more user friendly and adaptive to the particular environment of use, it would be beneficial to provide a cooking appliance control system having at least certain set-up parameters which could be altered by a consumer such that the appliance can be, to some extent, customized.

Based on the above, there exists a need in the art for a cooking appliance which can be conveniently programmed to perform and display information concerning successive cooking operations. In addition, there exists a need in the art for a cooking appliance incorporating a control system which permits the modification of pre-set operating parameters of the appliance, such that the appliance can be somewhat customized by a consumer.

SUMMARY OF THE INVENTION

In accordance with the present invention, a cooking appliance is provided with a program control and display system that enables successive cooking operations for a single oven cavity to be established and permits the display of information to a user concerning both cooking operations. In particular, the cooking appliance can be programmed to perform successive cooking operations, such as a baking operation after a toasting operation. For instance, when a first cooking operation is already underway, a second operation can be programmed, with the display indicating the different cooking operations selected, as well as the amount of time before the second operation will be initiated.

The control system of the present invention is designed to ease the inputting of program information by a user, as well as to convey status information to the user. Furthermore, the system can be re-programmed by a user in order to change default set-up parameters. For example, the control system can be modified to change the display language, temperature scale, display illumination level, display scrolling speed and end-of-operation audible signaling duration.

Additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF THE PREFERRED EMBODIMENT

Figure 1:
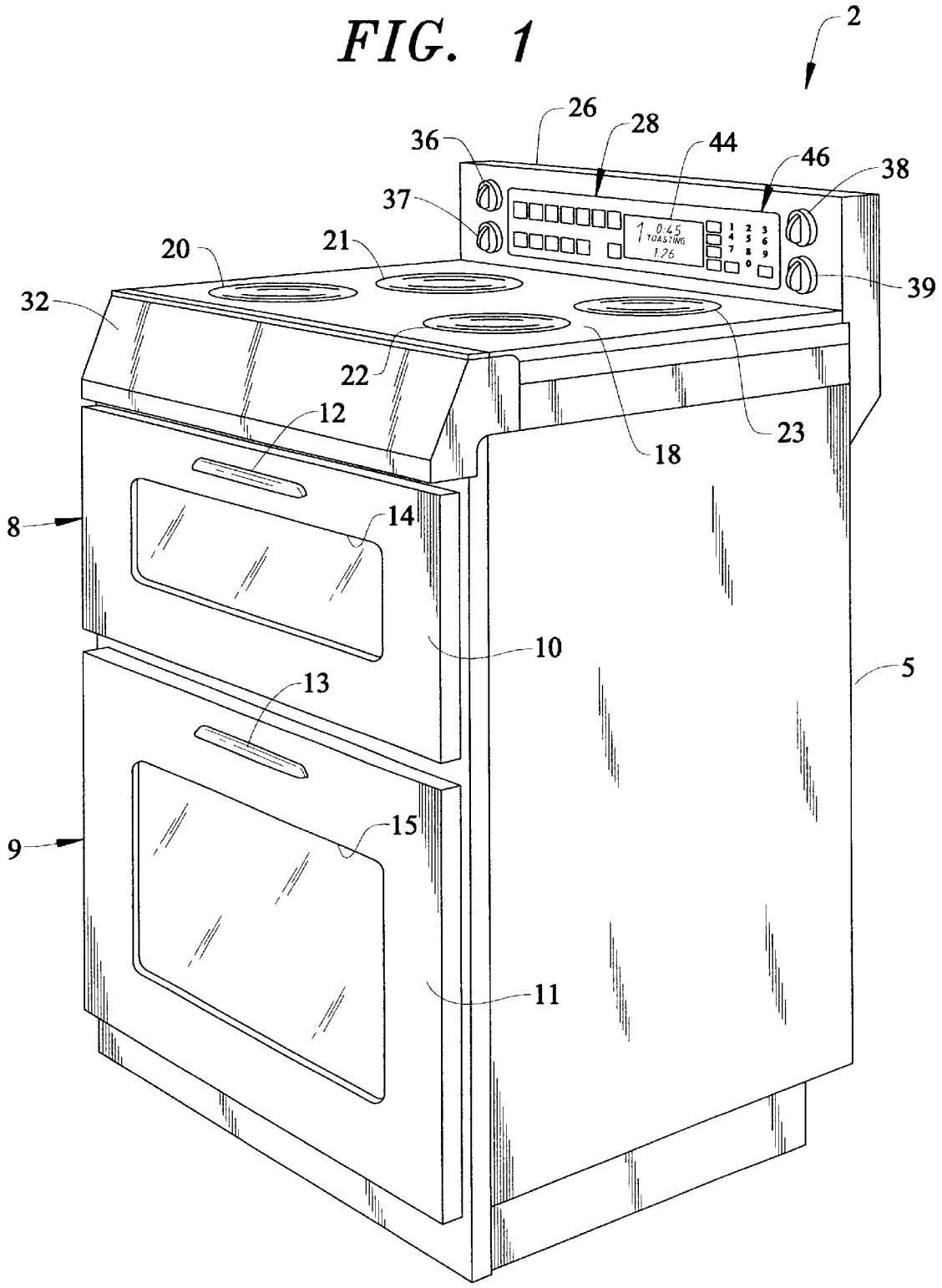
FIG. 1 is a perspective view of an electric range incorporating the program control and display system of the present invention.

With initial reference to FIG. 1, the invention is illustrated for use in connection with an electric range generally indicated at 2. In the embodiment shown, electric range 2 includes a cabinet 5 within which is arranged a first or upper oven 8 and a second or lower oven 9. Upper and lower ovens 8 and 9 have associated doors 10 and 11 which are respectively provided with handles 12 and 13 that can be used to pivot doors 10 and 11 in order to access respective cooking chambers of ovens 8 and 9. For the sake of completeness, this figure illustrates doors 10 and 11 with respective viewing windows 14 and 15.

Cabinet 5 is also provided with an associated range top 18 which supports various spaced surface heating elements 20–23 in a manner known in the art. At an upper rear portion, cabinet 5 includes an upstanding portion 26 which is provided with a control panel 28. At this point, it should be realized that the arrangement and location of control panel 28 could vary in accordance with the present invention. For example, control panel 28 could be located along an upper face panel 32 of cabinet 5. In any event, upstanding portion 26 includes a plurality of knobs 36–39 for use in selectively activating and deactivating surface heating elements 20–23 respectively. Control panel 28 is preferably arranged between knobs 36–39 and is shown to include a substantially central display 44, such as an LED, LCD or VFD display unit. Furthermore, control panel 28 is provided with a number pad generally indicated at 46 that has an associated button 48 for use in setting a clock arranged either within display 44 or in another portion of control panel 28.

Figure 2:
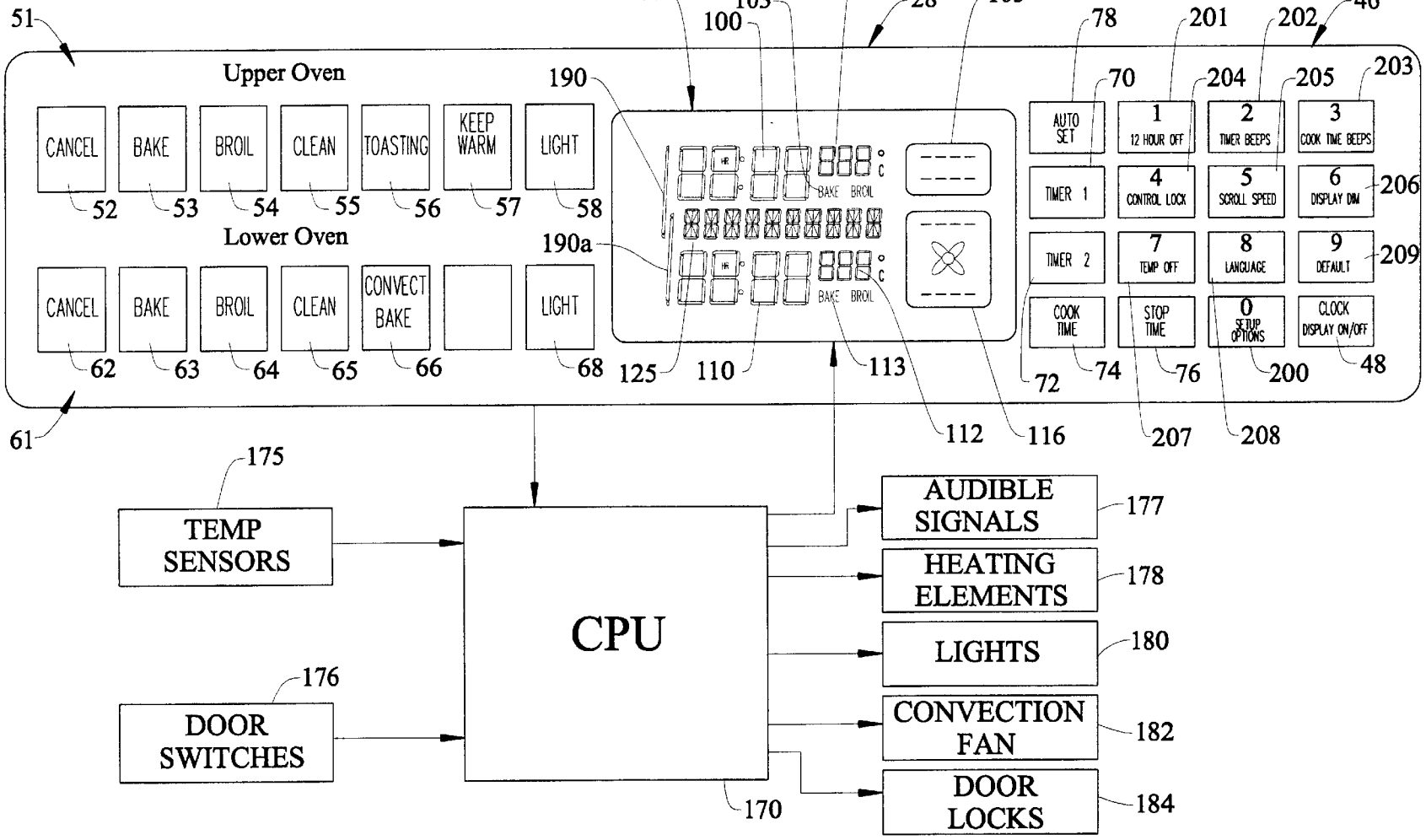
FIG. 2 is a generally schematic view of the program control and display system according to a preferred embodiment of the invention.

In more detail and particularly with reference to FIG. 2, control panel 28 of range 2 includes a first row of control buttons generally indicated at 51 which are generally used to establish an operational mode for upper oven 8. As shown, first row 51 includes a cancel button 52, a bake button 53, a broil button 54, a cleaning mode button 55, a toasting button 56, a warming mode establishing button 57 and a light control button 58. In a generally similar manner, a second row of control buttons 61 are provided for lower oven 9. In the most preferred form of the invention, second row 61 includes a cancel button 62, a bake button 63, a broil button 64, a cleaning mode button 65, a convection mode establishing button 66 and a light control button 68. In the most preferred form of the invention, the user is able to program the operation of at least upper and lower ovens 8 and 9 through the use of the first and second rows of buttons 51 and 61, along with numeric pad 46, timer buttons 70 and 72, cook time and stop time buttons 74 and 76, and an auto set button 78. Since this basic programming arrangement is known in the art and not considered part of the present invention, it will not be described further here in detail. Of course, as also known in the art, light buttons 58 and 68 enable a consumer to selectively activate lights (not shown) provided in upper and lower ovens 8 and 9 respectively, with the lights being usable in combination with windows 14 and 15 to view the progress of a cooking operation.

FIG. 2 illustrates additional details of the program control and display system of the present invention which will now be described in detail. First of all, it should be noted that display 44 is provided with numerous display zones. As will be detailed more fully below, some of these zones provide information which relates to the operation of only a particular one of ovens 8 and 9, while at least one display zone represents a common area for displaying information for a selected one of the ovens 8 and 9. In accordance with the invention, display 44 visually links the common area to a respective one of the dedicated areas in order to convey to the user exactly which oven 8, 9 the information displayed in the common area relates to.

More specifically, display 44 includes a first display zone 100 which is used to convey programmed timing information for upper oven 8. Zone 100 can also be used as a clock display area, at least during nonoven use periods, as well as countdown time data established through timer button 70 independent of oven operation. Adjacent first display zone 100 is a second display zone 102 which is arranged above a third display zone 103. Second display zone 102 preferably defines a numeric temperature display area for oven 8, while zone 103 defines an alpha display used to convey certain operational mode information for oven 8. Slightly offset from zones 102 and 103 is a fourth display zone 105. In the most preferred form of the invention, zone 105 is boxed off and capable of displaying upper and/or lower generally horizontal bars which reflect the activation status of upper and/or lower heating elements (not shown) provided within upper oven 8. Therefore, depending upon which mode button 53–57 is depressed, zone 105 will indicate the corresponding activation of either or both of the upper and lower heating elements for upper oven 8.

Display 44 includes a fifth display zone 110 which generally functions in a manner corresponding to first display zone 100 in that zone 110 conveys programmed time information. However, zone 110 is dedicated to convey information for lower oven 9. Adjacent zone 110 are sixth and seventh display zones 112 and 113. Zone 112 is used to convey temperature information for lower oven 9, such as the temperature set by a user utilizing numeric pad 46. The selected operational mode for lower oven 9 is displayed in display zone 113. Therefore, if lower oven 9 is to be used to bake some food product at 425° F., zone 112 would numerically display the temperature and zone 113 would display the word "BAKE". Adjacent zones 112 and 113 is another boxed area which constitutes display zone 116. Zone 116 is provided with upper and lower bar displaying portions for conveying information concerning the activation/deactivation of upper and lower heating elements (not shown) provided in lower oven 9 in a manner directly analogous to zone 105. In addition, zone 116 can also display a symbol indicative of the activation of a convection fan (not shown) for lower oven 9 upon depression of mode button 66. In any event, zone 116 is dedicated to displaying information relating to lower oven 9.

At this point, it should be noted that the number, form, content and particular arrangement of the various zones of display 44 can greatly vary in accordance with the invention such that the drawings and above description merely set forth the most preferred arrangement. Due to the construction of display 44 in accordance with the most preferred form of the invention, zones 103 and 113 only provide dedicated information concerning selected operational modes for upper oven 8 and lower oven 9 respectively. Most preferably, zones 103 and 113 are limited to displaying "BAKE" and "BROIL" operational modes for the upper and lower ovens 8 and 9. In order to be able to convey additional alpha information, display 44 includes a common, central zone 125 that is used to display operational information for each of upper and lower ovens 8 and 9. As will be detailed more fully below, common zone 125 preferably has an associated default, in accordance with the preferred embodiment, which results in the displaying of information concerning the current operational mode for upper oven 8.

Selections inputted by the user of range 2 through control panel 28 are relayed to a central processing unit (CPU) 170. CPU 170 also receives other signals, such as signals indicative of the temperatures in upper and lower ovens 8 and 9 from sensors 175 and door opening/closing status signals from switches 176 associated with both oven doors 10 and 11. Based on the signals received, CPU 170 outputs control signals to timer and end of cooking operation audible signalers at 177, heating elements associated with upper and lower ovens 8 and 9 as indicated at 178, lights for ovens 8 and 9 as indicated at 180, a convection fan as indicated at 182, door locks as indicated at 184 and to display 44. In general, the invention is concerned with providing and controlling the display in common zone 125 and the manner in which the information displayed in common zone 125 is linked to a particular one of ovens 8, 9 as will be detailed below.

As shown, common display zone 125 is preferably located between dedicated zones 100 and 110. Due to this location and the use of zone 125 to display alpha information for both upper and lower ovens 8 and 9, display 44 also incorporates structure used to link information in common display zone 125 with display information for a respective one of the upper and lower ovens 8 and 9. In accordance with the most preferred form of the invention, an information link in the form of a display bracket 190 is provided. For example, "TOASTING" could be presented in display zone 125 when this operation has been selected and upper bracket 190, which extends from first display zone 100 to common zone 125, would be illuminated to thereby link the display information in common zone 125 to upper oven 8. Of course, a corresponding lower bracket arrangement **190*a* would be used to link common zone 125 to dedicated display zone 110 when the information provided in common zone 125 relates to the operation of oven 9** as indicated in this figure.

Common zone 125 is actually used to display numerous messages to a user of range 2, with the displayed information being presented on a predetermined priority basis. That is, an array of words and phrases that are displayed in a priority viewing basis, based on ease of use and convenience, is available for common zone 125. Range 2 allows multiple cooking functions and timed features to be active simultaneously with the highest priority alpha message being displayed in common zone 125. In accordance with the most preferred embodiment, there are three primary priority displays, at least one override message and appliance fault indications. To indicate the operation of upper oven 8, common zone 125 can display "TOASTING" and "KEEP WARM" messages. For lower oven 9, "CONVECTION" is available for display. In addition, common operational messages of "CLEANING", "CLEANED" and "PREHEAT" are available.

For example, assume that alpha display zone 125 indicates that a "TOASTING" mode has been selected and information link bracket 190 indicates that the toasting operation is associated with the upper oven. This alpha display would be maintained for the entire operation unless the user alters the cooking functions. If additional time is desired for the already established mode of operation, numeric pad can be directly accessed and, utilizing the toasting operation as an example, the toast time could be changed directly without having to further press mode button 56. If it is desired to adjust the operation of lower oven 9, the suitable mode button 63, 64 or 66 would be depressed, the bracket 190 would extend across the common area 125 and dedicated zone 110 (see lower bracket shown in dotted lines in FIG. 2) and the other controls could be directly utilized to select the desired cook time and operation. After the programming is completed, bracket 190 would again return to the higher priority state associated with upper oven 8. After the toast time expires, the word "TOASTING" would be changed to "COMPLETE", preferably followed by a user selectable set of reminder beeps. The word "COMPLETE" would be removed from common display zone 125 and the beeps would terminate simply by opening of the oven door 10 as sensed by switch 176. Therefore, "TOASTING", "KEEP WARM" and "CONVECTION" represent priority displays, "COMPLETE" is an override display and appliance faults indications such as sensor errors, door open conditions and the like also take priority over programmed information.

To this point, the invention has been described with reference to an electric range 2 which has the upper and lower ovens 8 and 9. However, as will become more fully evident below, this construction for range 2 and its associated controls has generally been provided for the sake of completeness. The present invention, in accordance with certain aspects thereof, is particularly directed to the ability of CPU 170 to be programmed so as to enable successive cooking operations to be performed in and displayed for either upper oven 8 or lower oven 9. Therefore, as far as the present invention is concerned, the cooking appliance need only include a single oven cavity. Furthermore, the invention is concerned with enabling certain set-up parameters stored within CPU 170 for the cooking appliance to be modified by a consumer such that the overall system can be generally customized. These details of the invention will now be described with particular reference to FIG. 2.

In accordance with a first aspect of the invention, CPU 170 can be programmed by a user to enable successive cooking operations to be performed, with display 44 providing information concerning each cooking operation. For exemplary purposes, reference will be made to the programming of upper oven 8 in performing successive toasting and baking operations. With this example, toasting button 56 would be initially depressed. Thereafter, the consumer would be prompted to enter timing information through number pad 46. The toasting operation is performed with both the baking and broiling elements (not shown) of range 2 being activated. After programming the toasting operation, i.e., directly after this programming or anytime during the toasting operation, the baking operation can be preprogrammed. For instance, assuming that the toasting operation is underway and the bake button 53 is depressed, central zone 125 of display 44 will read "TOASTING WAIT–MIN". Depressing bake button 54 again will cause the user to be prompted to enter a desired duration and temperature for the baking operation through number pad 46. Thereafter, display 44 will read "HEATING DELAYED–MIN". In each case, the "–" refers to the time remaining in the toasting operation or, equally, the amount of time until the baking operation starts. In the most preferred form of the invention, the time is rounded up to the nearest minute. Once this time period has elapsed, the baking operation automatically starts.

With this arrangement, successive operations can be programmed. Again, the combination toasting/baking operation has been described by way of an example such that other desired cooking combinations could also be performed. Advantageously, display 44 automatically conveys the time until the second cooking operation, before the second operation is actually initiated, and CPU 170 will start the second cooking operation without the need to enter a start time or stop time. Depending on the successive cooking operations selected, a certain delay may occur before the second operation actually commences. For instance, if a warming operation is to follow a baking operation, a time delay will be employed that will allow the baking element to cool to a desired temperature, say 200° F. as determined by temperature sensor 175, before the heating element will again be activated.

In accordance with another aspect of the invention, as clearly shown in FIG. 2, number pad 46 includes individual buttons 200–209 for numbers 0–9 respectively. Buttons 200–209 can be utilized to set temperature and time values as discussed above. However, in accordance with the present invention, each of buttons 200–209 are also used for a second purpose. More specifically, these buttons 200–209 can be used to alter various pre-established set-up parameters for range 2. In the most preferred form of the invention, the zero button 200 can also be used to initiate a set-up parameter change. That is, button 200 can be pressed by the user to initiate a parameter change, one of buttons 201–209 and clock button 48 can be pressed to select a desired parameter to change and then auto set button 78 is used to enter the change made. Preferably, when button 200 is pressed, third display zone 125 scrolls the phrase "PRESS DESIRED PAD FOR SELECTION" until one of buttons 48 or 201–209 is pressed, although either cancel button 52 or 62 can be used to exit the program mode.

As shown in FIG. 2, button 201 is used to change a time displayed in first display zone 100 between 12 and 24 hour displays. Therefore, if a 12 hour time display is to be changed to a 24 hour display, the depression of button 200 would be followed by the depression of button 201 and then the auto set button 78. If the consumer does not desire the time to be shown in display 44, the clock button 48 can be pressed after setup option button (zero button) 200, followed by the auto set button 78. In this embodiment, the clock is an atomic clock so that no setting of the time by the consumer is ever needed.

Buttons 202 and 203 are used to adjust the duration of the beeps emanating at 177 as controlled by CPU 170 when either a timing operation, as established through the use of timer buttons 70 and 72 and number pad 46, or a cooking operation, as described above, is completed. In the most preferred form of the invention, the default for the timer beeps is 5 minutes and 30 minutes for a cooking operation. However, these times can be switched between 5 and 30 minute time limits through the use of button 200, the appropriate button 202, 203 and auto set button 78.

The remaining buttons 204–209 operate in a commensurate manner. For instance, button 204 is preferably used to lock the control buttons so as to prevent any inadvertent altering of the set parameters. During each of the parameter changing sequences, it is preferable to have the third display zone 125 scroll through instructions. For example, when button 200 is pressed, third display zone 125 will scroll through "PRESS DESIRED PAD FOR SELECTION" for the entire entry time. Third display zone 125 will actually scroll the current set-up parameter and what needs to be done by the consumer to alter the parameter. When multiple selections are to be made, the auto set button 78 toggles from one selection to the next. The scroll speed for third display zone 125 can be altered through button 205 between slow, medium and fast speeds.

The degree to which display 44 is illuminated can be controlled through button 206. Once the dim function has been selected, each depression of auto set button 78 will alter the intensity level from bright to dim and back to bright again. In the most preferred embodiment, third display zone 125 will provide an alphanumeric signal between "*" and "******", with the latter representing the brightest available setting for display 44**. Preferably, the user is given a predetermined time to complete the change, e.g., thirty seconds. Default for the dimming option is preferably the highest intensity available.

Button 207 can be used to select between Fahrenheit and Centigrade temperature scales. Preferably, a single tone at 177 will be provided when this set-up is selected and the current setting will be displayed in third display zone 125. For example, "DEGREES F—PRESS AUTO SET TO CHANGE" will scroll across third display zone 125. The user will have a preset time limit (thirty seconds) to choose the desired temperature scale by using the auto set button 78 to toggle between the two scales. The default is preferably the Fahrenheit scale.

Button 208 can be used to select English, French or Spanish as the display language. Third display zone 125 can be changed from English to French to Spanish by pressing of the auto set button 78 once the setup option button 200 is pressed, followed by button 208. The current language will be displayed in alphanumeric display zone 125. For instance, "ENGLISH—PRESS AUTO SET TO CHANGE", "FRANCAIS—APP SUR AUTO SET POUR MODIFIER" or "ESPANOL—PRESIONE AUTO SET PARA CAMBIARLO" will be presented. The default value for the language option is English.

Button 209 is used to re-establish the factory pre-set parameter values. Preferably, a single tone will be generated and third display zone 125 will read "PRESS AUTO SET FOR FACTORY SETTINGS". The user will have thirty seconds to choose the factory settings. When the auto set button 78 is pressed, display 125 will read "FACTORY SETTINGS COMPLETE". Again, the programming mode can be exited by pressing a cancel button 52, 62 or allowing the respective predetermined programming time periods to elapse.

With this arrangement, the consumer will have the ability to utilize range 2 with the factory established set-up parameters, or these parameters can be individually change to provide a customized system. Although described with respect to the preferred embodiment of the invention, it should be readily understood that various changes and/or modifications can be made to the invention without departing from the spirit thereof. For example, although the invention has been described with respect to electric range 2, the invention also has applicability to other types of appliance units including gas ranges, wall ovens, microwave ovens and the like. Certainly, additional buttons could be provided for the set-up parameter changing aspect of the invention or other ones of the buttons provided could be utilized. In general, the invention is only intended to be limited by the scope of the following claims.

We claim:

1. A cooking appliance having operational and display programming capabilities comprising:

first and second oven cavities each including at least one heating source for regulating a temperature within a respective one of the oven cavities in order to cook food items placed within the respective oven cavity;

a plurality of control elements for programming operational information for each of the first and second oven cavities of the cooking appliance, including selected operational modes and times for first and second successive cooking operations;

a control system, linked to the plurality of control elements, for receiving signals representative of the selected operational modes and times and regulating activation of the at least one heating source to perform the first cooking operation and then automatically initiating the second cooking operation, wherein the first and second oven cavities can be separately controlled through the plurality of control elements and the control system; and a visual, alphanumeric display, interconnected to the control unit, for conveying information concerning both of the first and second successive cooking operations, with the visual display providing operational information for each of the first and second oven cavities.

2. The cooking appliance according to claim 1, wherein the visual display conveys an amount of time until the start of the second cooking operation during the first cooking operation.

3. The cooking appliance according to claim 2, wherein the visual display conveys the selected operational mode for each of the first and second cooking operations prior to starting of the second cooking operation.

4. The cooking appliance according to claim 1, wherein the cooking appliance constitutes a range including a plurality of surface heating elements.

5. The cooking appliance according to claim 1, wherein the visual display provides operational information for each of the first and second oven cavities on a predetermined priority basis.

6. The cooking appliance according to claim 5, further comprising: means for sensing appliance fault conditions, wherein the control system causes the visual display to convey sensed fault conditions on a priority basis over programmed operational information.

7. The cooking appliance according to claim 1, wherein the control system waits a preset delay period from a termination of the first cooking operation to automatically initiate the second cooking operation.

8. The cooking appliance according to claim 1, wherein the visual display scrolls through the operational information.

9. A cooking appliance having operational and display programming capabilities comprising:

an oven cavity including at least one heating source for regulating a temperature within the oven cavity in order to cook food items placed within the oven cavity;

a plurality of control elements for programming operational information for the cooking appliance, with the operational information including a selected operational mode and time for a cooking operation, as well as various set-up parameters for the cooking appliance;

a visual, alphanumeric display for conveying certain of the programmed operational information to a user; and a control system linked to the plurality of control elements for receiving signals representative of the programmed operational information in order to regulate activation of the at least one heating source and establish the set-up parameters of the cooking appliance, said control system being further interconnected to the visual display to convey the certain of the programmed operational information in a form based on the established set-up parameters.

10. The cooking appliance according to claim 9, wherein a group of the control elements are used in programming both the operational time and set-up parameters.

11. The cooking appliance according to claim 9, wherein the group of the control elements are presented in a number pad including individual buttons for numbers 0–9, with at least a plurality of the individual buttons doubling as set-up control buttons.

12. The cooking appliance according to claim 9, wherein the plurality of control elements and the control system include means for establishing a display language for the visual display.

13. The cooking appliance according to claim 9, wherein the plurality of control elements and the control system include means for scrolling the visual display at an adjustable scroll speed.

14. The cooking appliance according to claim 9, wherein the plurality of control elements and the control system include means for establishing pre-set default values for the various set-up parameters.

15. The cooking appliance according to claim 9, wherein the plurality of control elements and the control system include means for locking out use of the plurality of control elements.

16. The cooking appliance according to claim 9, wherein the visual display can further function to convey clock information and said control system includes means for disabling the clock information.

17. The cooking appliance according to claim 9, further comprising: means for providing audible signals upon termination of a programmed operation and wherein the plurality of control elements and the control system include means for selectively varying at least a duration of the audible signals.

18. A method of programming and displaying operational information for a cooking appliance in the form of a range including an oven cavity provided with at least one heating source and a plurality of surface heating elements comprising:

receiving operational information indicative of desired operational modes and times for first and second successive cooking operations within the oven cavity;

activating the at least one heating source to perform the first cooking operation;

automatically initialing the second cooking operation after the first cooking operation; and visually conveying information concerning both of the first and second cooking operations in a display.

19. The method according to claim 18, further comprising: visually displaying an amount of time until the start of the second cooking operation during the first cooking operation.

20. The method according to claim 18, further comprising: visually displaying the desired operational mode for each of the first and second cooking operations prior to starting of the second cooking operation.

21. A method of programming and displaying operational information for a cooking appliance including an oven cavity provided with at least one heating source comprising:

receiving operational information indicative of a desired operational mode and time for a cooking operation, as well as at least one appliance set-up parameter;

regulating the at least one heating source based on the desired operational mode and time;

establishing a new appliance set-up parameter based on the operational information received; and visually displaying certain of the programmed operational information in an alphanumeric form which is based on the new set-up parameter.

22. The method of claim 21, further comprising: utilizing a common group of control elements to input both the operational time and set-up parameter.

23. The method of claim 21, wherein the establishing of a new appliance set-up parameter constitutes selecting a language for the displaying of the programmed operational information.

24. The method of claim 21, wherein the establishing of a new appliance set-up parameter constitutes selecting a scrolling speed for the displaying of the programmed operational information.

25. The method of claim 21, wherein the establishing of a new appliance set-up parameter constitutes altering a duration for audible signals provided upon termination of a programmed operation.

26. The method of claim 21, wherein the establishing of a new appliance set-up parameter constitutes altering a temperature scale used in displaying of the programmed operational information.

* * * * *